US011660832B2

(12) United States Patent
Kambara et al.

(10) Patent No.: US 11,660,832 B2
(45) Date of Patent: May 30, 2023

(54) PAPER STACK PRESS MACHINE

(71) Applicant: Horizon International Inc., Takashima (JP)

(72) Inventors: Kanta Kambara, Takashima (JP); Kohei Okamoto, Takashima (JP)

(73) Assignee: HORIZON INTERNATIONAL INC., Shiga (JP)

( * ) Notice: Subject to any disclaimer, the term of this patent is extended or adjusted under 35 U.S.C. 154(b) by 267 days.

(21) Appl. No.: 16/996,080

(22) Filed: Aug. 18, 2020

(65) Prior Publication Data

US 2021/0053310 A1 Feb. 25, 2021

(30) Foreign Application Priority Data

Aug. 20, 2019 (JP) ..... JP2019-150574

(51) Int. Cl.
*B30B 15/06* (2006.01)
*B30B 1/00* (2006.01)
*B65H 37/00* (2006.01)

(52) U.S. Cl.
CPC ..... *B30B 15/062* (2013.01); *B30B 1/00* (2013.01); *B65H 37/00* (2013.01)

(58) Field of Classification Search
CPC ..... B30B 15/062; B30B 1/00; B30B 5/02; B30B 15/06; B30B 15/061; B65H 37/00
USPC ..... 100/214, 218
See application file for complete search history.

(56) References Cited

U.S. PATENT DOCUMENTS

| | | | | |
|---|---|---|---|---|
| 4,765,791 | A | 8/1988 | Brandt et al. | |
| 5,687,644 | A | 11/1997 | Rann et al. | |
| 2009/0095171 | A1* | 4/2009 | Futamura | B30B 15/0035 100/299 |
| 2009/0180857 | A1 | 7/2009 | Klein et al. | |

FOREIGN PATENT DOCUMENTS

| | | | |
|---|---|---|---|
| DE | 2753668 | A1 | 6/1979 |
| DE | 3540203 | A1 | 5/1987 |
| EP | 0751086 | A2 | 1/1997 |
| JP | 2010-274501 | A | 12/2010 |
| WO | 2007/147452 | A1 | 12/2007 |

OTHER PUBLICATIONS

Extended Search Report dated Jan. 25, 2021, issued in counterpart EP Application No. 20191655.8 (9 pages).

* cited by examiner

*Primary Examiner* — Shelley M Self
*Assistant Examiner* — Smith Oberto Bapthelus
(74) *Attorney, Agent, or Firm* — WHDA, LLP

(57) ABSTRACT

A paper stack press machine comprises a base 1 with a press surface 2, a pressing plate 5, and a pressing plate drive mechanism 6 moving the pressing plate between a standby position at which the pressing plate separates from a paper stack S on the press surface and a press position at which the pressing plate presses the paper stack against the press surface. A surface of the pressing plate facing the press surface is elastically deformable. A pushing bar 11*a* is arranged at the second side of the pressing plate so as to be movable in an axial direction thereof between a retracted position at which the pushing bar separates from the paper stack and an advanced position at which the pushing bar pushes the paper stack against the press surface.

2 Claims, 7 Drawing Sheets

PAPER STACK PRESS MACHINE

TECHNICAL FIELD

The present invention relates to a machine pressing a paper stack to release air from the paper stack.

BACKGROUND ART

For example, in a non-stich bookbinding, a paper stack is formed by a collator or a paper accumulating machine, and the paper stack is supplied to a clamper of a bookbinding machine in an aligned state.

Then the paper stack is transported between bookbinding processing units of the non-stich bookbinding machine by the clamper while being gripped by the clamper, and the paper stack is bond during this transport (see, for example, JP 2010-274501 A).

In this case, if the paper stack is not properly aligned and fed to the clamper, the finish of bookbinding will be poor or a defective product will occur.

For the reason, in the prior art, the paper stack is pressed in a thickness direction to release air from the paper stack after the paper stack is aligned, thereby the aligned paper stack is prevented from being disarranged easily.

Commonly, in order to release air from the paper stack, a paper stack press machine is used.

A conventional paper stack press machine includes a base having a flat press surface for support of a front or back side of the paper stack, a positioning mechanism for positioning the paper stack on the press surface, a pressing plate arranges opposite the press surface so as to be movable toward and away from the press surface, and a pressing plate drive mechanism moving the pressing plate between a standby position at which the pressing plate separates from the paper stack on the press surface and a press position at which the pressing plate presses a upper surface of the paper stack toward the press surface.

Thus the paper stack is placed on the press surface and the pressing plate moves from the standby position to the press position so that air is removed from the paper stack, and then the pressing plate moves from the press position to the standby position.

However, according to this configuration, when the pressing plate takes the press position, a flat inner surface of the pressing plate contacts the upper surface of the paper stack uniformly and simultaneously and accordingly, the air release from the paper stack is insufficient so that some gaps leave between paper sheets of the paper stack.

Consequently, when the pressing plate separates from the paper stack after completion of the air release, some paper sheets of the paper stack may float by following the pressing plate and the alignment of the paper stack may be disarranged.

SUMMARY OF THE INVENTION

Problems to be Solved by the Invention

It is, therefore, an object of the present invention to provide a paper stack press machine capable of release air from a paper stack reliably without disarranging an alignment of the paper stack.

Means for Solving the Problems

In order to achieve this object, the present invention provides a paper stack press machine comprising: a base having a flat press surface for support of a front or back side of a paper stack; a rectangular or square pressing plate arranged opposite the press surface so as to be movable toward and away from the press surface and having first and second sides opposed to each other; a pressing plate drive mechanism moving the pressing plate in a direction perpendicular to the press surface between a standby position at which the pressing plate separates from the paper stack, on the press surface and a press position at which the pressing plate presses the paper stack against the press surface, a surface of the pressing plate which faces the press surface being elastically deformable in a manner such that the surface of the pressing plate is inclined or curved so as to be gradually away from the press surface from the first side toward the second side of the pressing plate when the pressing plate takes the standby position, and the surface of the pressing plate gradually contacts the paper stack on the press surface from the first side toward the second side of the pressing plate while the pressing plate moves from the standby position to the press position, and the surface of the pressing plate is flat and parallel to the press surface when the pressing plate takes the press position; a pushing bar extending in a direction perpendicular to the press surface at the second side of the pressing plate and opposed to the press surface at a head thereof; and a pushing bar drive mechanism moving the pushing bar in an axial direction of the pushing bar between a retracted position at which the head of the pushing bar separates from the paper stack on the press surface and an advanced position at which the head of the pushing bar pushes the paper stack against the press surface, wherein the paper stack is placed on the press surface, and the pushing bar moves from the retracted position to the advanced position after the pressing plate moves from the standby position to the press position, thereafter the pushing bar moves from the advanced position to the retracted position after the pressing plate moves from the press position to the standby position.

According to a preferred embodiment of the present invention, the pressing plate is composed of a pressing plate body having the rectangular or square shape with the first and second sides and arranged opposite the press surface, and an auxiliary plate having elasticity and attached to a surface of the pressing plate body which faces the press surface so as to cover the surface of the pressing plate body, wherein the auxiliary plate is fixed to the second side of the pressing plate body at a first side thereof and inclined or curved so as to be away from the pressing plate body from the first side thereof toward the second side thereof.

Effect of the Invention

According to the present invention, when the paper stack is placed on the press surface and the pressing plate moves from the standby position to the press position, the paper stack is gradually pressed in a direction from the first side of the pressing plate toward the second side of the pressing plate by the pressing plate and accordingly, air existing between paper sheets of the sheet stack is pushed out in a direction from the first side of the pressing plate toward the second side of the pressing plate.

Thereby air is reliably removed from the paper stack.

After the air release is completed, the pushing bar moves from the retracted position to the advanced position and then the pressing plate moves from the press position to the standby position.

At this time, the pressing plate gradually separates from the paper stack from the second side thereof toward the first side thereof while a portion of the paper stack on which the press by the pressing plate is released the earliest (a portion of the paper stack located on the second side of the pressing plate) being pushed toward the pressing plate by the head of the pushing bar.

Consequently, the paper sheets of the paper stack do not float by following the pressing plate and the alignment of the paper stack is not disarranged.

Thereafter the pushing bar moves from the advanced position to the retracted position.

At this time, the contact area between the head of the pushing bar and the paper stack is small when the pushing bar takes the advanced position, so that the paper sheets of the paper stack do not float by following the pushing bar and the alignment of the paper stack is not disarranged.

Thus it is achieved to release air from the paper stack reliably without disarranging an alignment of the paper stack.

BEST MODE FOR CARRYING OUT THE INVENTION

A preferred embodiment of the present invention will be explained below with reference to accompanying drawings.

Figure 1A:
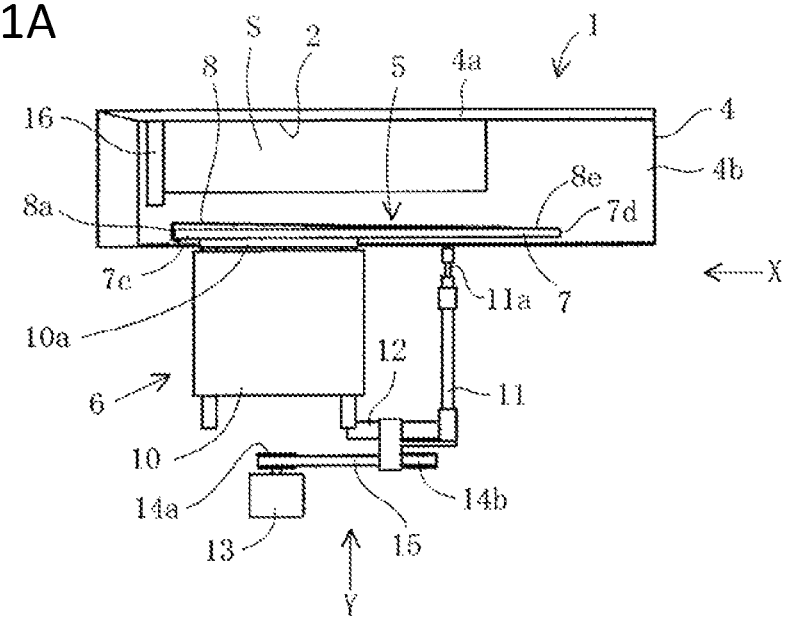
FIG. 1A is a plan view of a paper stack, press machine according to an embodiment of the present invention.
Figure 1B:
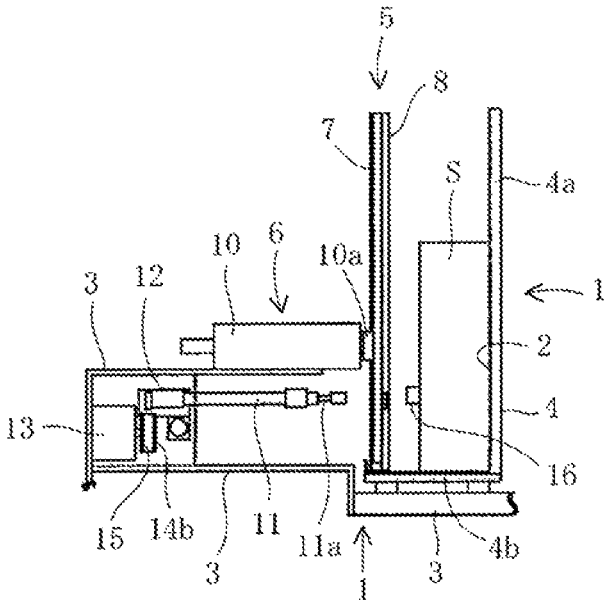
FIG. 1B is a side view seen in a direction of an arrow X in FIG. 1A.
Figure 2A:
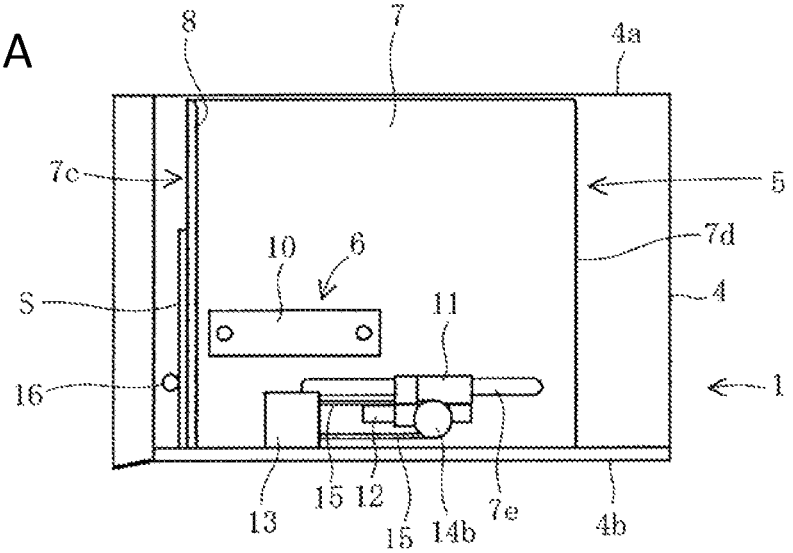
FIG. 2A is a front view seen in a direction of an arrow Y in FIG. 1A.
Figure 2B:
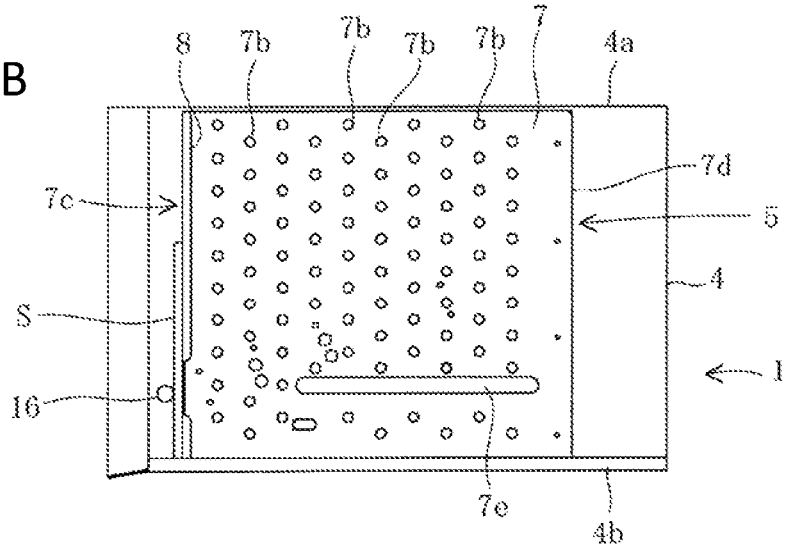
FIG. 2B is a view showing a detailed configuration of a pressing plate, excluding structural elements around the pressing plate in FIG. 2B.

FIG. 1A is a plan view of a paper stack press machine according to an embodiment of the present invention, and FIG. 1B is a side view seen in a direction of an arrow X in FIG. 1A. FIG. 2A is a front view seer, in a direction of an arrow Y in FIGS. 1A and 2B is a view showing a detailed configuration of a pressing plate, excluding structural elements around the pressing plate in FIG. 2B.

In FIGS. 1A, 1B, 2A and 2B, a frame of the paper stack press machine is omitted.

Figure 3:
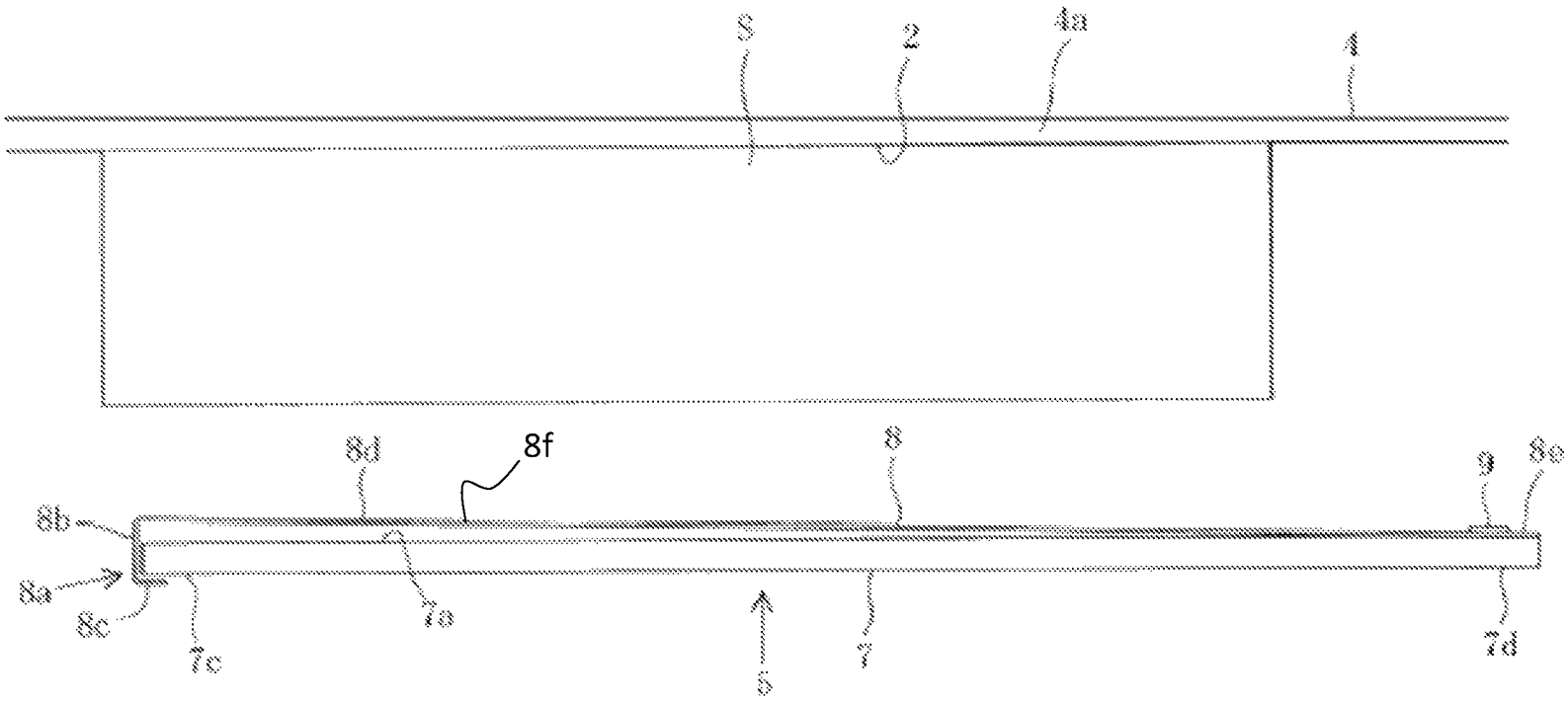
FIG. 3 is an enlarged plan view of the pressing plate of the paper stack press machine of FIGS. 1A and 1B, in which the pressing plate tales a standby position.
Figure 4:
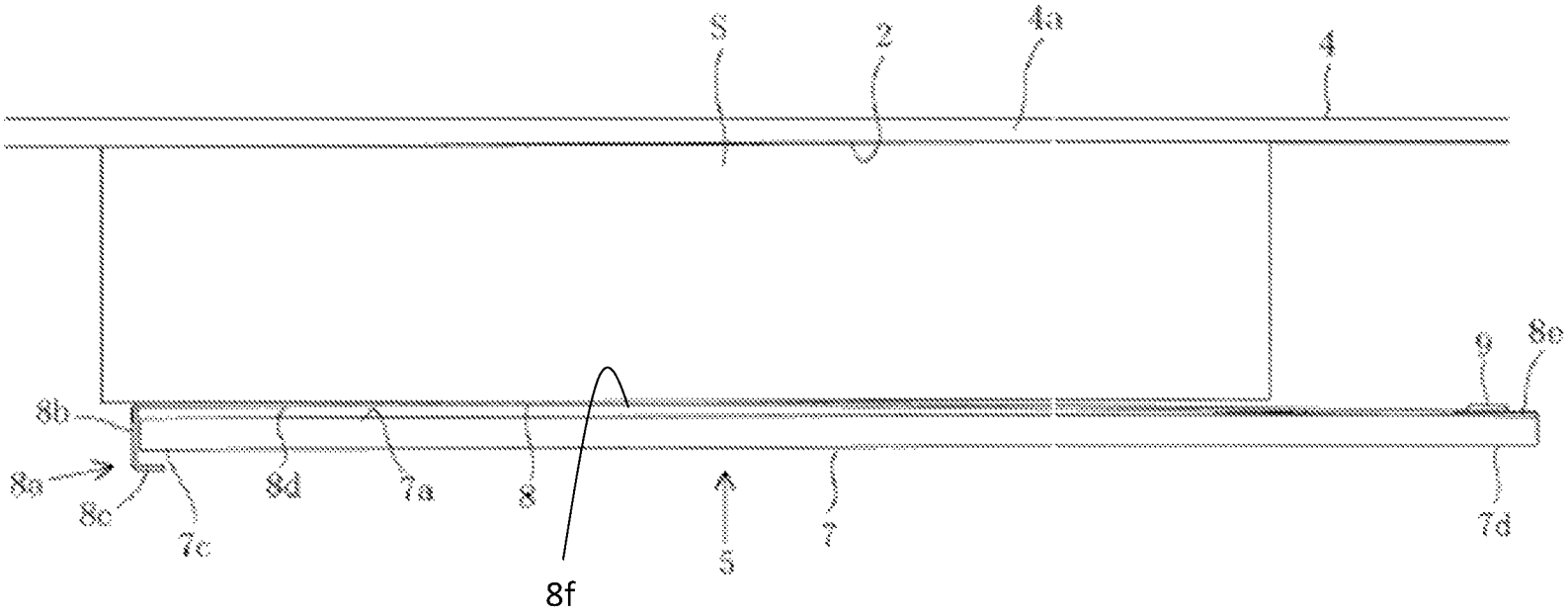
FIG. 4 is an enlarged plan view of the pressing plate of the paper stack press machine of FIGS. 1A and 1B, in which the pressing plate is in the middle of a moving path from the standby position to the press position.
Figure 5:
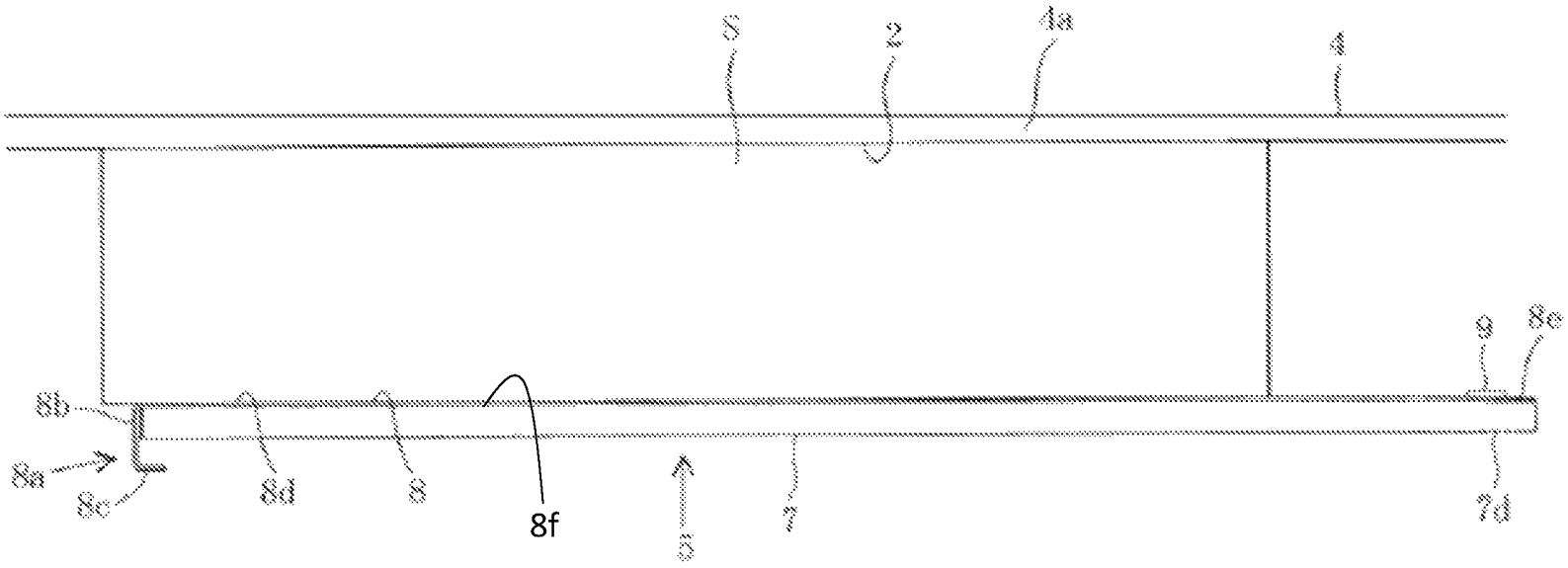
FIG. 5 is an enlarged plan view of the pressing plate of the press machine of FIGS. 1A and 1B, in which the pressing plate takes the press position.

FIGS. 3 to 5 are enlarged plan views of a pressing plate of the paper stack press machine of FIGS. 1A and 1B, and in FIG. 3, the pressing plate takes a standby position, and in FIG. 4, the pressing plate is in the middle of a moving path from the standby position to a press position, and in FIG. 5, the pressing plate takes the press position.

As shown in FIGS. 1A, 1B, 2A and 2B, the paper stack press machine of the present invention comprises a base 1 having a flat press surface 2 for support of a front or back side of a paper stack S.

The base 1 is composed of a frame 3, and a horizontal plate 4 with L-shaped cross section attached to the frame 3 in a way such that an inside surface of the plate 4 opens upwardly and both a vertical wall 4*a* and a horizontal wall 4*b* of the plate 4 slope.

A portion of the inside surface of the plate 4 forms a press surface 2.

The paper stack S is placed on the press surface 2 in such a manner that a front or back surface of the paper stack S is supported by the press surface 2 and a side of the paper stack S is supported by an inside surface of the horizontal wall 4*b* of the plate 4.

It should be noted that FIGS. 1A and 1B is drawn as a plan view of the paper stack press machine viewed in a direction toward the sloping vertical wall 4*a* of the plate 4.

The paper stack press machine also comprises a pressing plate 5 arranged opposite the press surface 2 so as to be movable toward and away from the press surface 2, and a pressing plate drive mechanism 6 moving the pressing plate 5 in a direction perpendicular to the press surface 2 between a standby position at which the pressing plate 5 separates from the paper stack S on the press surface 2 and a press position at which the pressing plate 5 press the paper stack S against the press surface 2.

As shown in FIGS. 2A to 5, in this embodiment, the pressing plate 5 has a rectangular or square pressing plate body 7 having first and second sides (short sides) 7*c*, 7*d* opposed to each other.

The pressing plate body 7 is arranged opposite the press surface 2 in a way such that a pair of long sides thereof extend in a longitudinal direction of the vertical wall 4*a*.

The pressing plate further has an auxiliary plate 8 having elasticity and attached to a surface 7*a* of the pressing plate body 7 which faces the press surface 2 so as to cover the surface 7*a*.

As shown in FIG. 2B, the pressing plate body 7 has air vent holes 7*b*.

The auxiliary plate 8 has a rectangular flat plate shape provided with first and second sides (short sides) 8*a*, 8*e* opposed to each other.

The first side 8*a* of the auxiliary plate 8 is bent to form a first bent portion 8*b*, and a front end of the first bent portion 8*b* is bent inward to form a second bent portion 8*c*.

In this case, the first bent portion 8*b* and an auxiliary plate body 3*d* take the form of an acute angle while the second bent portion 8*c* and the first bent portion 8*b* take the form of a right angle.

The auxiliary plate 8 is attached to the second side 7*d* of the pressing plate body 7 at the second side thereof 8*e* through screws 9 in a manner such that the auxiliary plate 8*d* is opposed to the surface 7*a* of the pressing plate body 7 and the first side 7*c* of the pressing plate body 7 is located between the second bent portion 8*c* and the auxiliary plate body 8*d* of the auxiliary plate 8.

An outside surface of the auxiliary plate body 8*d* forms a surface 8*f* of the pressing plate 5 facing the press surface 2.

Thus, as shown in FIG. 3, when the pressing plate 5 takes the standby position (when external force is not applied to the auxiliary plate 8), the inside surface of the second bent portion 8*c* of the auxiliary plate 8 contacts the pressing plate body 7 and the auxiliary plate 8 (auxiliary plate body 8*d*) is inclined or curved so as to be gradually away from the pressing plate body 7 from the second side thereof 8*e* toward the first side thereof 8*a*.

Although not shown in the drawings, similar to the pressing plate body 7, the auxiliary plate 8 also has air vent holes.

In this embodiment, as shown in FIGS. 1A, 1B, 2A and 2B, the pressing plate drive mechanism 6 is composed of a cylinder (air or hydraulic cylinder) 10 arranged opposite the vertical wall 4*a* of the plate 4 with respect to the pressing plate 5.

The cylinder 10 is attached to the frame 3 in such a way that a rod thereof 10*a* can reciprocates in a direction perpendicular to the press surface 2.

Then the pressing plate body 7 is fixed to a head of the rod 10*a* of the cylinder 10 at a surface thereof far from the press surface 2.

Thus the pressing plate 5 is moved in a direction perpendicular to the press surface 2 between the standby position (see, FIG. 3) and the press position (see, FIG. 5) by the cylinder 10.

The auxiliary plate 8 (auxiliary plate body 8*d*) is, as shown in FIG. 3, inclined or curved so as to be gradually away from the press surface 2 from the first side thereof 8*a* toward the second side thereof 8*e* when the pressing plate 5 takes the standby position, and, as shown in FIG. 4, gradually contacts the paper stack S on the press surface 2 from the first side thereof 8*a* toward the second side thereof 8*e* while the pressing plate 5 moves from the standby position to the press position, and is, as shown in FIG. 5, flat and parallel to the press surface 2 when the pressing plate 5 takes the press position.

A cylinder 11 (air or hydraulic cylinder) is arranged opposite the press surface 2 with respect to the pressing plate body 7 and on the side of the second side 7*d* of the pressing plate foody 7.

The cylinder 11 extends perpendicularly to the press surface 2 and a head of a rod thereof 11*a* is opposed to the pressing plate body 7, that is, the press surface 2.

The cylinder 11 is slidably mounted on a slide guide 12 fixed to the frame 3 and extending parallel to the press surface 2 and in a longitudinal direction of the plate 4.

On the one hand, as shown in FIG. 2B, an area of the pressing plate body 7 facing the head of the rod 11*a* is provided with a slit 7*e* which the rod 11*a* can penetrate. The slit 7*e* extends from the second side 7*d* toward the first side 7*c* of the pressing plate body 7 (parallel to the slide guide 12).

Although not shown in the drawings, a portion of the auxiliary plate 8 corresponding to the slit 7*e* of the pressing plate body 7 is also provided with the corresponding slit.

The rod 11*a* of the cylinder 11 functions as a pushing bar movable between an advanced position at which the rod 11*a* passes through the slit 7*e* of the pressing plate body 7 and the slit of the auxiliary plate 8 so as to push the paper stack S against the press surface 2 at the head thereof and a retracted position at which the head of the rod 11*a* separates from the paper stack S on the press surface 2.

A motor 13 is attached to the frame 3 on the opposite side of the pressing plate 5 with respect to the slide guide 12 in a way such that a drive shaft of the motor 13 extends perpendicularly to the press surface 2, and a pulley 14*a* is fixed to the drive shaft of the motor 13.

A pulley 14*b* is spaced from the pulley 14*a* in the lengthwise direction of the slide guide 12 and attached to the frame 3 so as to be rotatable around an axis parallel to the drive shaft of the motor 13.

Furthermore, an endless belt 15 is extended between the pulley 14*a* and the pulley 14*b*, and the cylinder 11 is fixed to the endless belt 15.

The cylinder 11, that is, the rod (pushing bar) 11*a* can be translated by drive of the motor 13 in a direction from the first side 7*c* toward the second side 7*d* of the pressing plate body 7 (direction from the first side of the pressing plate toward the second side of the pressing plate 5) within the slit 7*e* of the pressing plate body 7.

The configuration for translating the rod 11*a* in the direction from the first side toward the second side of the pressing plate 5 is provided as needed.

In this embodiment, the paper stack press machine of the present invention comprises a transport claw 16 for transporting the paper stack S along the plate 4.

Although not shown in the drawings, a chain drive mechanism is attached to the frame 3 on the opposite side of the pressing plate with respect to the vertical wall 4*a* of the plate 4 and extending in a longitudinal direction of the vertical wall 4*a*, and the vertical wall 4*a* is provided with a slit extending the longitudinal direction of the vertical wall 4*a*.

Then the transport claw 16 is attached to the chain drive mechanism so as to protrude from the slit of the vertical wall 4*a* toward the press surface side perpendicularly to the vertical wall 4*a*.

The transport claw 16 is moved intermittently by the chain drive mechanism.

Every time the paper stack press machine carries out the press motion, the paper stack S is transported to the press surface 2 by pushing one side thereof with the transport claw 16 while being supported by the vertical wall 4*a* of the plate 4 at the front or back side thereof and being supported by the horizontal wall 4*b* of the plate 4 at a side thereof at a right angle to the one side thereof.

Then the behavior of the paper stack press machine of the present invention will be described.

FIGS. 6A to 6C and FIGS. 7A and 7B are views similar to FIG. 1A showing the behavior of the paper stack press machine of FIG. 1A and FIG. 1B.

Figure 6A:
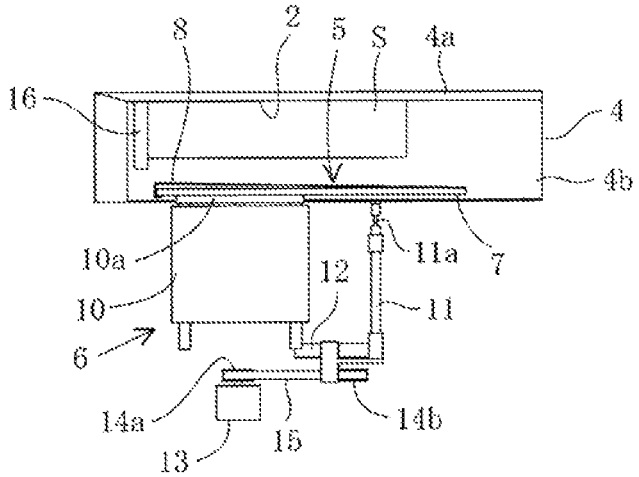
FIGS. 6A to 6C are views similar to FIG. 1A showing the behavior of the paper stack press machine of FIGS. 1A and 1B.

As shown in FIG. 6A, when the paper stack S is arranged on the press surface 2 by the transport claw 16, the pressing plate 5 is located at the standby position and the rod (pushing bar) 11*a* of the cylinder 11 is located at the retracted position.

In this case, the position of the rod (pushing bar) 11*a* is preset based on the size information of the paper stack S in such a manner that the rod (pushing bar) 11*a* corresponds to an end of the paper stack S far from the transport claw 16 on the press surface 2.

Figure 6B:
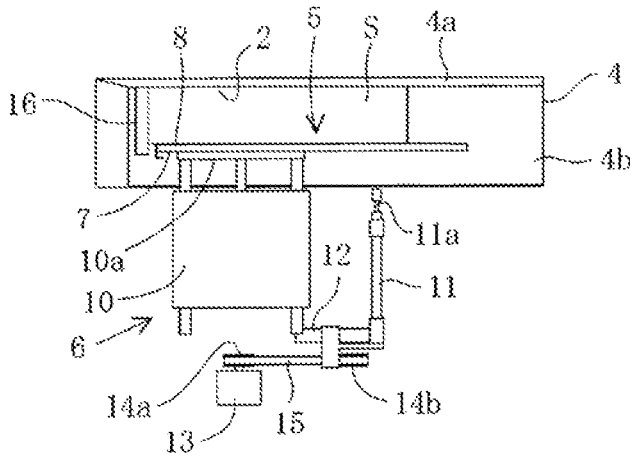

Next, as shown in FIG. 6B, the pressing plate 5 moves to the press position so as to remove air from the paper stack S.

At this time, the paper stack S is gradually pressed from an end thereof nearer to the transport claw 16 toward an end thereof far from the transport claw 16 (in a direction from the first side of the pressing plate 5 toward the second side of the pressing plate 5) by the pressing plate 5 and accordingly, air existing between paper sheets of the sheet stack S is pushed out from the end thereof nearer to the transport claw 16 toward the end thereof far from the transport claw 16 (in a direction from the first side of the pressing plate 5 toward the second side of the pressing plate 5).

Thereby air is reliably removed from the paper stack S.

Figure 6C:
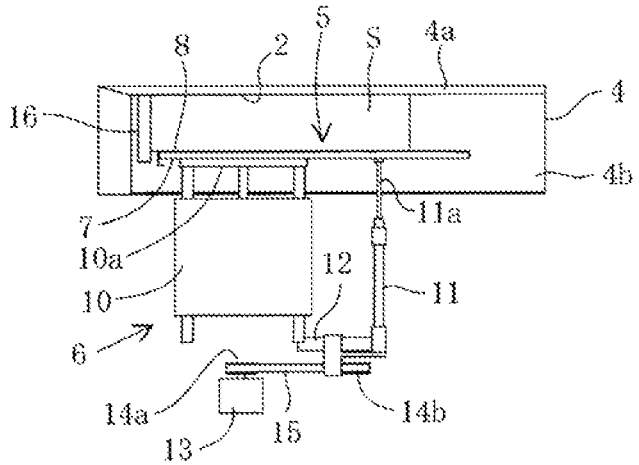
Figure 7A:
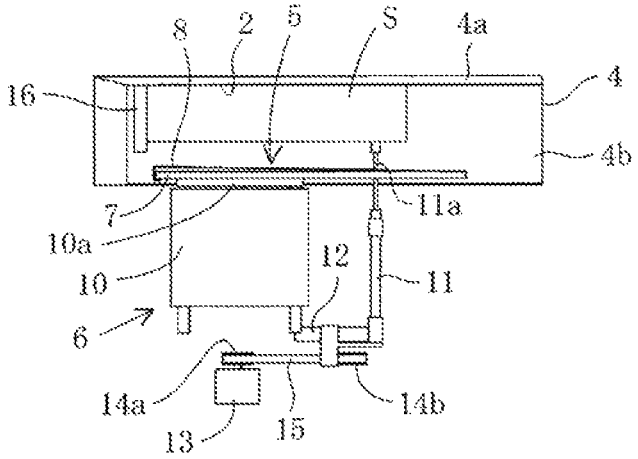
FIGS. 7A and 7B are views similar to FIG. 1A showing the behavior of the paper stack press machine.

After the air release is completed, as shown in FIG. 6C, the rod (pushing bar) 11*a* moves to the advanced position and then, as shown in FIG. 7A, the pressing plate 5 moves from the press position to the standby position.

At this time, the pressing plate 5 gradually separates from the paper stack S from the second side thereof toward the first side thereof while a portion of the paper stack S on which the press by the pressing plate 5 is released the earliest (a portion of the paper stack S located on the second side of the pressing plate 5) being pushed toward the press surface 2 by the head of the rod (pushing bar) 11*a*.

Consequently, the paper sheets of the paper stack S do not float by following the pressing plate 5 and the alignment of the paper stack S is not disarranged.

Figure 7B:
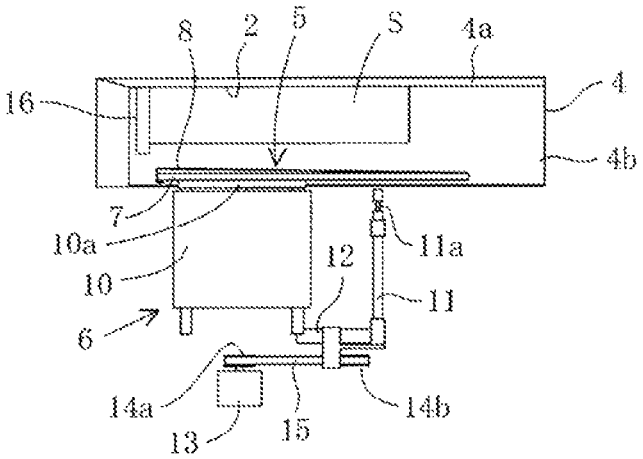

Thereafter, as shown in FIG. 7B, the rod (pushing bar) 11*a* moves from the advanced position to the retracted position so that the press operation (air release) ends.

At this time, the contact area between the head of the rod (pushing bar) 11*a* and the paper stack S is small when the rod (pushing bar) 11*a* takes the advanced position, so that the paper sheets of the paper stack S do not float by following the rod (pushing bar) 11*a* and the alignment of the paper stack is not disarranged.

Thus, according to the paper stack press machine of the present invention, it is achieved to release air from the paper stack S reliably without disarranging an alignment of the paper stack S.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present invention.

For example, although the pressing plate 5 is composed of the pressing plate body 7 and the auxiliary plate 3 in the above embodiment, a configuration of the pressing plate is not limited to the above embodiment.

The pressing plate 5 may have any configuration as long as the surface of the pressing plate 5 which faces the press surface 2 is elastically deformable in a manner such that the surface of the pressing plate 5 is inclined or curved so as to be gradually away from the press surface 2 from the first side toward the second side of the pressing plate 5 when the pressing plate 5 takes the standby position, and the surface of the pressing plate 5 gradually contacts the paper stack S on the press surface 2 from the first side toward the second side of the pressing plate 5 while the pressing plate 5 moves from the standby position to the press position, and the surface of the pressing plate 5 is flat and parallel to the press surface 2 when the pressing plate 5 takes the press position.

Although the press surface 2 is inclined in the above embodiment, the press surface 2 may be horizontal.

Although the paper stack S is supplied on the press surface 2 by the transport claw 16 in the above embodiment, a structure for supplying the paper stack S on the press surface 2 is not limited to the above embodiment and a well-known appropriate mechanism for supplying the paper stack S may be used.

DESCRIPTION OF REFERENCE NUMERALS

1 Base
2 Press surface
3 Frame
4 Plate
4*a* Vertical wall
4*b* Horizontal wall
5 Pressing plate
6 Pressing plate drive mechanism
7 Pressing plate body
7*a* Surface
7*b* Air vent hole
7*c* First side
7*d* Second side
7*e* Slit
8 Auxiliary plate
8*a* First side
8*b* First bent portion
8*c* Second bent portion
3*d* Auxiliary plate body
9 Screw
10 Cylinder
10*a* Rod
11 Cylinder
11*a* Rod
12 Slide guide
13 Motor
14*a* Pulley
14*b* Pulley
15 Endless belt
16 Transport claw
S Paper stack

The invention claimed is:

1. A paper stack press machine comprising:

a base having a flat press surface for support of a front or back side of a paper stack;

a rectangular or square pressing plate arranged opposite the press surface so as to be movable toward and away from the press surface and having first and second sides opposed to each other;

a pressing plate drive mechanism moving the pressing plate in a direction perpendicular to the press surface between a standby position at which the pressing plate separates from the paper stack on the press surface and a press position at which the pressing plate presses the paper stack against the press surface, a surface of the pressing plate which faces the press surface being elastically deformable in a manner such that the surface of the pressing plate is inclined or curved so as to be gradually away from the press surface from the first side toward the second side of the pressing plate when the pressing plate takes the standby position, and the surface of the pressing plate gradually contacts the paper stack on the press surface from the first side toward the second side of the pressing plate while the pressing plate moves from the standby position to the press position, and the surface of the pressing plate is flat and parallel to the press surface when the pressing plate takes the press position; and a pushing bar extending in a direction perpendicular to the press surface at the second side of the pressing plate and opposed to the press surface at a head thereof;

wherein the paper stack is placed on the press surface, and the pushing bar moves from a retracted position at which the head of the pushing bar separates from the paper stack on the press surface to an advanced position at which the head of the pushing bar pushes the paper stack against the press surface after the pressing plate moves from the standby position to the press position, thereafter the pushing bar moves from the advanced position to the retracted position after the pressing plate moves from the press position to the standby position.

2. The paper stack press machine according to claim 1, wherein the pressing plate is composed of a pressing plate body having the rectangular or square shape with the first and second sides and arranged opposite the press surface, and an auxiliary plate having elasticity and configured to cover the surface of the pressing plate body, wherein the auxiliary plate is fixed to the second side of the pressing plate body at the second side thereof and inclined or curved so as to be away from the pressing plate body from the second side thereof toward the first side thereof.

* * * * *